US011324667B2

(12) United States Patent
Yang et al.

(10) Patent No.: US 11,324,667 B2
(45) Date of Patent: May 10, 2022

(54) SILICONE TUBE COUPLED BABY FEEDING BOTTLE

(71) Applicant: ART TECHNIQUE CO., LTD., Gwangju-si (KR)

(72) Inventors: Jin Souk Yang, Namyangju-si (KR); In Sook Ha, Incheon (KR)

(73) Assignee: ART TECHNIQUE CO., LTD., Gyeonggi-do (KR)

( * ) Notice: Subject to any disclaimer, the term of this patent is extended or adjusted under 35 U.S.C. 154(b) by 164 days.

(21) Appl. No.: 16/767,585

(22) PCT Filed: Feb. 3, 2018

(86) PCT No.: PCT/KR2018/001474
§ 371 (c)(1),
(2) Date: May 27, 2020

(87) PCT Pub. No.: WO2019/112118
PCT Pub. Date: Jun. 13, 2019

(65) Prior Publication Data

US 2020/0383876 A1 Dec. 10, 2020

(30) Foreign Application Priority Data

Dec. 4, 2017 (KR) ..... 10-2017-0164949

(51) Int. Cl.
*A61J 9/06* (2006.01)
*B65D 53/02* (2006.01)

(52) U.S. Cl.
CPC ..... *A61J 9/0607* (2015.05); *B65D 53/02* (2013.01)

(58) Field of Classification Search
CPC ... A61J 9/0607; A61J 17/1111; A61J 11/0055; A61J 11/02; A61J 11/04; B65D 53/02
See application file for complete search history.

(56) References Cited

U.S. PATENT DOCUMENTS 5,183,229 A * 2/1993 Duggan ..... A61J 9/0684 215/11.1
2004/0061031 A1* 4/2004 Lange ..... A61J 9/0607 248/102

(Continued)

FOREIGN PATENT DOCUMENTS

JP 2005-046216 A 2/2005
KR 20-0212800 Y1 2/2001

(Continued)

*Primary Examiner* — Amy J. Sterling
(74) *Attorney, Agent, or Firm* — IP Legal Services, LLC

(57) ABSTRACT

The present invention relates to a baby feeding bottle. The baby feeding bottle employs a simple structure in which an assembly portion having a ring-shaped assembly groove is formed on the outside of the top of a feeding bottle body, a horizontal stop protrusion portion and a vertical coupling protrusion portion are formed on the outside of the bottom of the feeding bottle body, a silicone tube is fined into the outside of the feeding bottle body, a ring coupling portion at the upper end of the silicone tube assembly groove is coupled to the assembly portion in a sealed manner by being inserted to the assembly portion, and a horizontally bent portion at the lower end of the silicone tube is coupled to the stop protrusion portion in a sealed manner by locating the horizontally bent portion and then pressing the horizontally bent portion with the sealing cap.

3 Claims, 6 Drawing Sheets

(56) References Cited

U.S. PATENT DOCUMENTS

| | | | | |
|---|---|---|---|---|
| 2008/0173612 | A1 | 7/2008 | Renz | |
| 2011/0168714 | A1 | 7/2011 | Renz | |
| 2013/0087524 | A1* | 4/2013 | Nuckles | A61J 9/005 215/395 |
| 2014/0027403 | A1 | 1/2014 | Renz | |
| 2015/0335534 | A1 | 11/2015 | Renz | |
| 2019/0201294 | A1 | 7/2019 | Renz | |
| 2021/0000696 | A1* | 1/2021 | Yang | A61J 11/02 |

FOREIGN PATENT DOCUMENTS

| | | | |
|---|---|---|---|
| KR | 20-0322317 | Y1 | 8/2003 |
| KR | 20-2009-0000707 | U | 1/2009 |
| KR | 10-2009-0091821 | A | 8/2009 |
| KR | 10-1228637 | B1 | 1/2013 |
| KR | 10-1588406 | B1 | 2/2016 |

* cited by examiner

SILICONE TUBE COUPLED BABY FEEDING BOTTLE

CROSS REFERENCE TO RELATED APPLICATIONS

This application is a national envy application of International Application No. PCT/KR2018/001474 filed on Feb. 3, 2018, which claims priority to Korean Application No. 10-2017-0164949 filed on Dec. 4, 2017, the entire contents of which are herein incorporated by reference in its entirety.

TECHNICAL FIELD

The present invention relates generally to a baby feeding bottle that couples and uses an air-tillable tithe to the amide of the feeding bottle, and more particularly to a silicone tube coupled baby feeding bottle that employs a simple structure in which a silicone tube is directly fitted into the outside of a feeding bottle without a separate cover and the upper and lower ends of the silicon the are coupled in a sealed manner, so that manufacturing cost is reduced, assembly and disassembly are facilitated, foreign materials are prevented from entering the inside thereof, and the cleaning of the inside thereof is facilitated by flipping the silicone tube, thereby being easy to use and excellent in hygiene.

TECHNICAL BACKGROUND

In general, baby feeding bottles have long shapes and are made of hard synthetic resin materials, and thus the texture actually felt by infants with their hands is hard and is thus not desirable.

In particular, in infancy, tactile feeling, coziness and warmth are very important for emotional development. For this reason, it is known that infants who are breastfed feel more tactile feeling, coziness and warmth when breastfeeding directly through mothers' breasts rather than feeding bottles, which is desirable for emotional development.

In order to solve the problems of the conventional infant feeding bottle, Korean Utility Model Registration No. 20-0212800 discloses an infant feeding bottle, in which in order to give a feeling of mother's milk to the feeding bottle, a separate second cover configured to receive the feeding bottle and a first cover attached onto the outside of the second cover and configured such that a fixed portion configured to cover the upper shoulder of the feeding bottle protrudes from the upper old thereof are formed, and the first cover is formed in the shape of a tube made of silicone and is inflated by air injection thereinto, so that the infant feeding bottle helps infants feel soft and warm like in the case of mothers' breasts when they eat mothers' milk or milk and also provides a comfortable fit to the hands of the infants, thereby allowing the infants to drink the milk comfortably.

However, the above-described baby feeding bottle has the following problems:

First, the second cover configured to accommodate the feeding bottle is separately manufactured and used in addition t the tube made of silicone outside the feeding bottle, and thus a problem arises in that the manufacturing cost increases.

Second, separate prevention coupling, is performed by covering the upper shoulder of the feeding bottle with the first cover, and thus inconvenience arises in that the feeding bottle could not be easily separated after it has been coupled.

In this case, a cap is formed between the feeding bottle and the second cover and thus foreign materials easily enter and contaminate the feeding bottle, so that problems arise in that the aesthetics of the feeding, bottle is damaged and the hygiene of the feeding bottle is deteriorated due to the contamination.

In particular, it is difficult to separate the feeding bottle and the second cover flow each other and thus the cleaning of foreign materials is inconvenient, so that a problem arises in that it is mom difficult to use the feeding bottle more hygienically.

DETAILED DESCRIPTION

Problems to be Solved

The present invention has been conceived to overcome the above-described problems of the prior art, and an object of the present invention is to provide a silicone tube coupled baby feeding bottle that employs a simple structure in which a silicone tube is directly fined into the outside of a feeding bottle without a separate cover, the ring coupling portion of the upper end of the silicone tube is coupled to the assembly groove in a sealed manner, and the horizontally bent portion of the lower end of the silicone tube is coupled in a sealed manner by the screw coupling of a sealing cap, so that manufacturing cost is reduced, assembly and disassembly are facilitated, foreign materials are prevented from entering the inside thereof, and the cleaning of the inside thereof is facilitated b flipping the silicone tube thereby providing excellent economic efficiency, usability and hygiene.

SUMMARY OF INVENTION

The present invention is characterized b providing, a silicone tube coupled baby feeding bottle, wherein an assembly portion configured to protrude from the outside of the top of a feeding bottle body and to ha a ring-shaped assembly groove, a stop protrusion portion configured to extend horizontally from the outside of the bottom of the feeding bottle body, and a coupling protrusion portion configured to extend vertically are formed, a silicone tube formed in a vertical hollow structure and configured such that a valve filling and discharging air is formed in one side thereof is fitted into the outside of the feeding bottle body, the upper end of the silicone tube is formed to be inwardly thicker than the tube, forms a ring coupling portion having a large dug-shaped cross-section and high elasticity, and is coupled to the assembly groove of the assembly portion in a sealed manner by being inserted to come into close contact with the assembly groove of the assembly portion, and the lower end of the silicone tube forms a horizontally bent portion inward, and is coupled in a sealed manner by locating the horizontally bent portion under the stop protrusion portion and then pressing the horizontally bent portion with the sealing cap screwed to the coupling protrusion portion.

The present invention is characterized in that the assembly portion of the feeding bottle body is formed such that a lower protrusion extends longer than an upper protrusion outward, thereby preventing the ring coupling portion of the silicone tube from being separated downward from the assembly portion.

The present invention is characterized in that at least one sealing ring configured to press and seal the lower end of the silicone tube, is inserted and disposed over the sealing cap.

Advantages of Invention

The present invention employs a simple structure in which the assembly portion having the ring-shaped assembly groove is formed on the outside of the top of the feeding bottle body, the horizontal stop protrusion portion and the vertical coupling protrusion portion are formed on the outside of the bottom of the feeding bottle body, the silicone tube is fitted into the outside of the feeding bottle body the ring coupling portion at the upper end of the silicone tube assembly groove is coupled to the assembly portion sealed manner by being inserted to come into close contact with the assembly portion, and the horizontally bent portion at the lower end of the silicone, tube is coupled to the stop protrusion portion in a sealed manner by locating the horizontally bent portion under the stop protrusion portion and then pressing the horizontally bent portion with the sealing cap screwed to the coupling protrusion portion, so that manufacturing cost is reduced, assembly and disassembly are facilitated, foreign materials are prevented from entering the inside thereof and the cleaning of the inside thereof is facilitated by releasing the sealing of the bottom of the silicone tube through the unfastening of the sealing cap and then flipping the silicone tube, thereby providing the effect of improving economic efficiency, usability, and hygiene.

EMBODIMENTS

Figure 1:
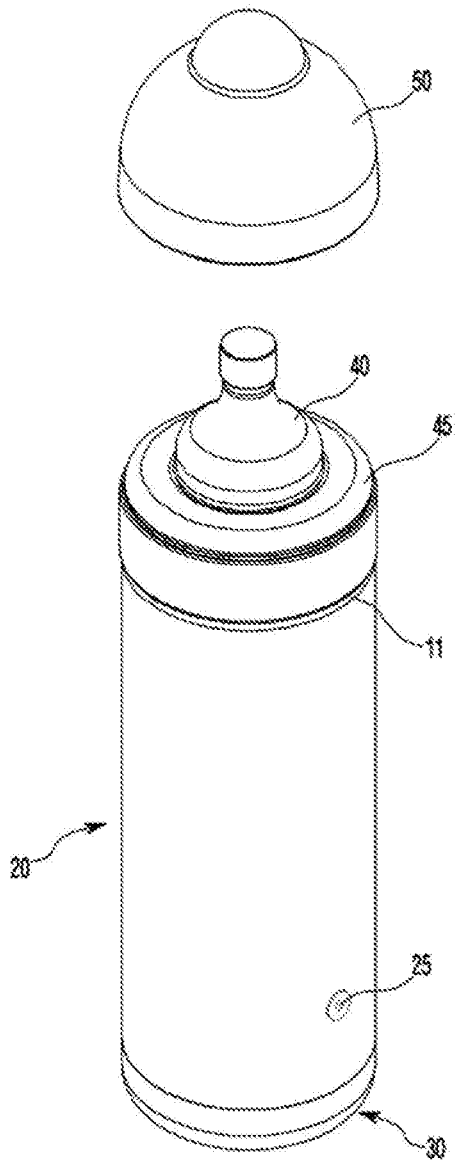
FIG. 1 is a perspective view showing the appearance of a feeding bottle according to the present invention.
Figure 2:
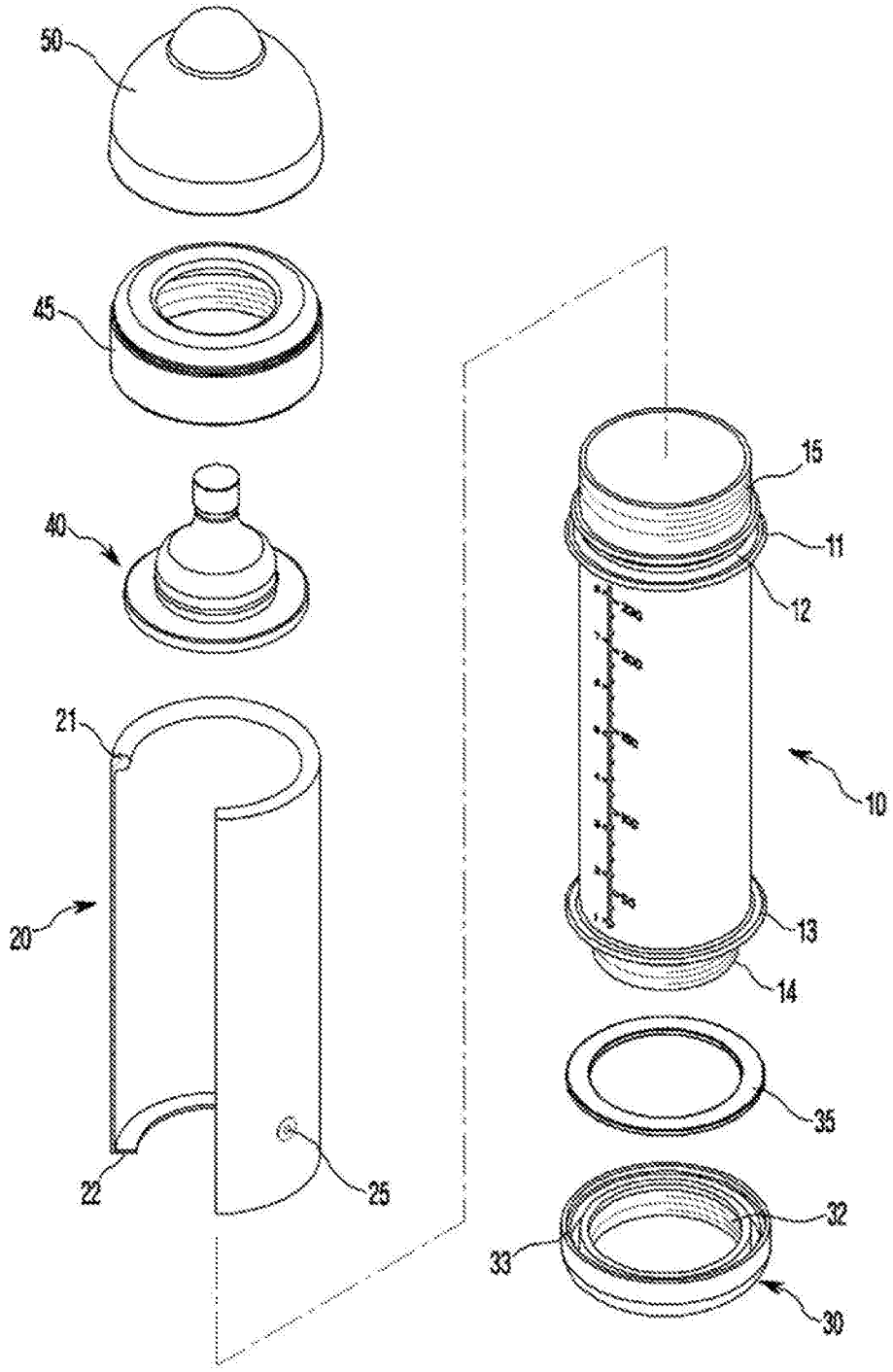
FIG. 2 is an exploded perspective view of FIG. 1.
Figure 3:
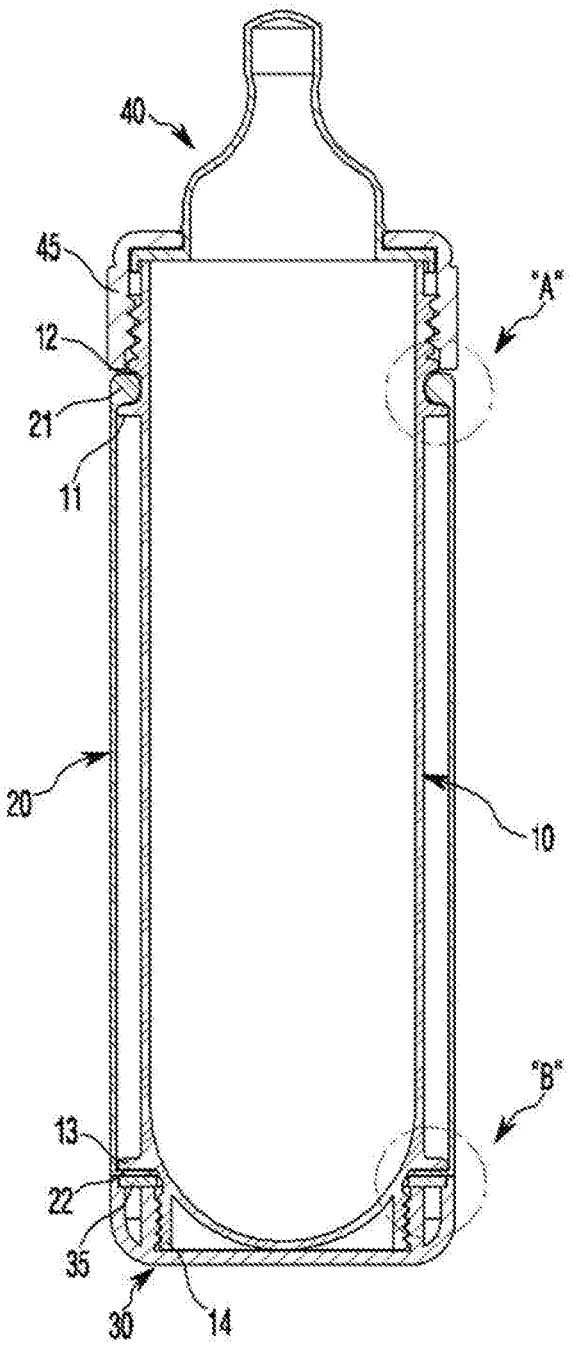
FIG. 3 is a sectional view of FIG. 1.
Figure 4:
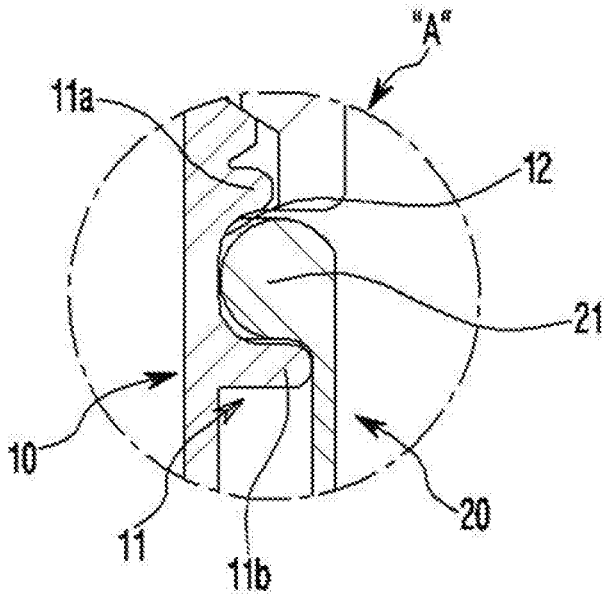
FIGS. 4 and 5 are enlarged views of portions "A" and "B" of FIG. 3.
Figure 5:
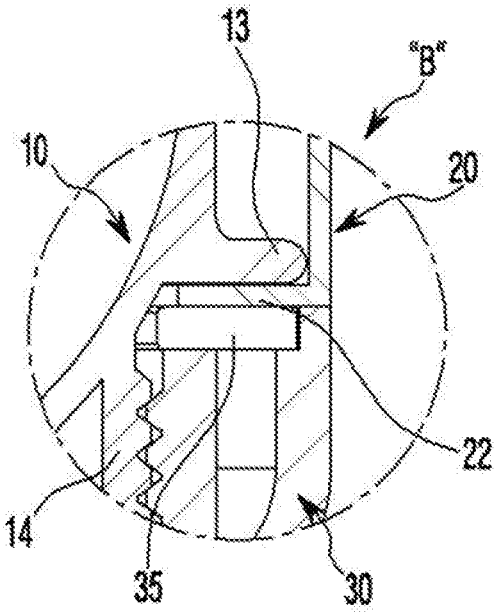
Figure 6:
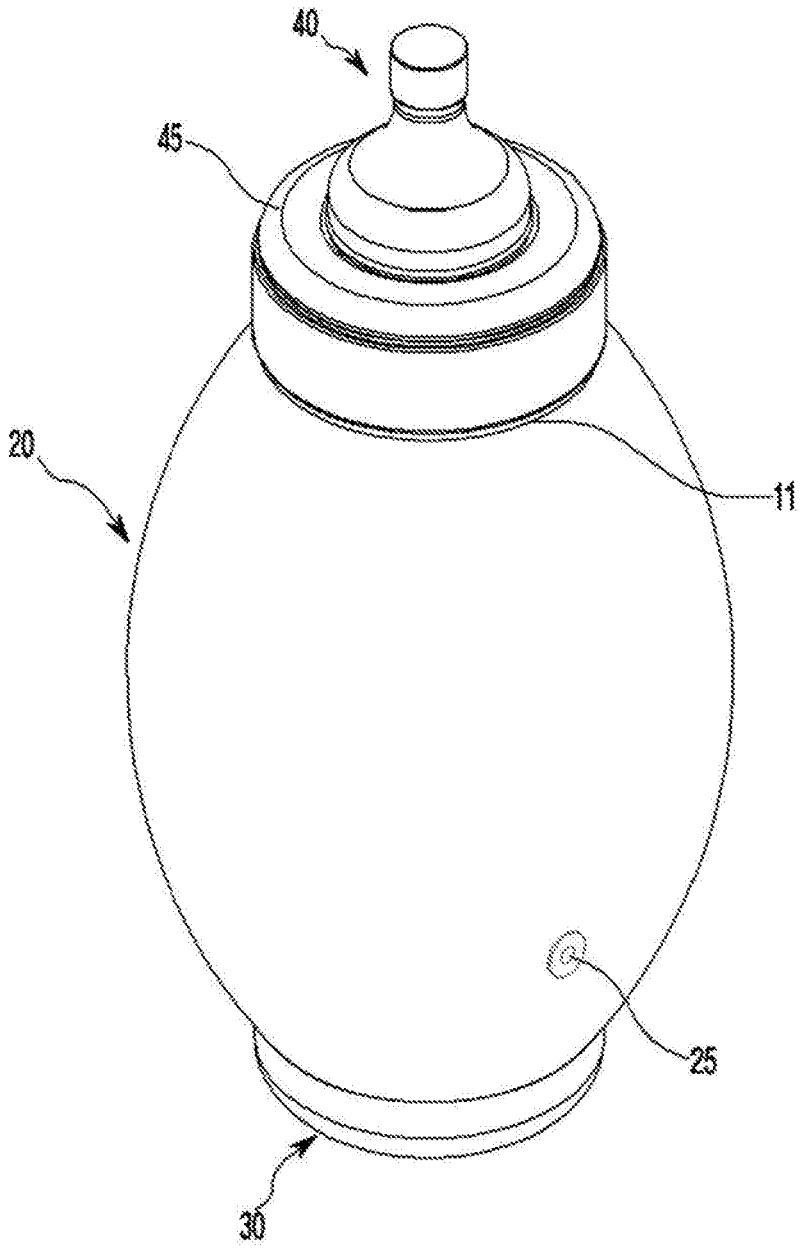
FIG. 6 is a perspective view of the appearance of air-filled state for FIG. 1.

Preferred embodiments of the present invention will be described in detail below with reference to the accompanying drawings.

As shown in FIGS. 1 to 7, the baby feeding bottle of the present invention includes a feeding bottle body 10, a silicone tube 20, a sealing cap 30, and a nipple 40.

The feeding bottle body 10 is configured by forming an assembly portion 11 configured to protrude from the outside of the top thereof and to have a ring-shaped assembly groove 12, a stop protrusion portion 13 configured to extend horizontally from the outside of the bottom thereof, and a coupling protrusion portion 14 configured to extend vertically.

Furthermore, a screw coupling portion 15 is further formed on the top of the assembly portion 11 of the feeding bottle body.

The silicone tube 20 is tanned in a vertical hollow structure. A valve 25 configured to fill and discharge air is formed in one side of the silicone tube 20. The silicone tube 20 is configured to be fitted into and coupled to the outside of the feasting bottle body. The upper end of the silicone tube 20 is formed to be inwardly thicker than the tube, forms a ring coupling portion 21 having a large ring-shaped cross-section and high elasticity, and is coupled to the assembly groove 12 of the assembly portion in a sealed manner by being inserted to come into close contact with the assembly groove 12 of the assembly portion. The lower end of the silicone tube 20 forms a horizontally bent portion 22 inward, and is coupled in a sealed manner by locating the horizontally bent portion 22 under the stop protrusion portion 13 and then pressing the horizontally bent portion 22 with the sealing cap 30 screwed to the coupling protrusion portion 14.

The assembly portion 11 of the feeding bottle body is formed such that a lower protrusion 11*b* extends longer than an upper protrusion 11*a* outward, so that the ring coupling portion 21 of the silicone tube can be easily inserted into the assembly groove 12 of the assembly portion 11 and is prevented from being separated downward.

Furthermore, at least one sealing ring 35 configured to press and seal the lower end of the silicone tube 20 is inserted and disposed over the sealing cap 30.

Furthermore, the nipple 40 is seated and disposed on the top of the feeding bottle body 10, and the coupling cap 45 is screwed to the stew coupling portion 15 in the upper portion of the feeding bottle body and fastens the nipple.

Reference symbol 32 designates a screw hole configured for screw coupling to the coupling protrusion portion 14 of the feeding bottle body, reference symbol 33 designates art insertion groove configured to receive the sealing ring 35, and reference symbol 32 designates a lid configured to be coupled over the nipple.

Next, the operation and operation of the present invention configured as described abuse will be described.

First, a proem of assembling the baby feeding bottle of the present invention will be described. The silicone tube 20 having a vertical hollow structure is fitted into the feeding bottle body 10 from a location above the feeding bottle body 10.

In this case, the ring coupling portion 21 protruding inward from the upper end of the silicone tube 20 is extended, and is inserted and mounted into the assembly groove 12 of the assembly portion formed on the outside of the upper portion of the feeding bottle body.

In particular, the ring coupling portion 21 is formed to have a ring-shaped cross-section so that it is thicker than the tube and has high elasticity. Accordingly, when the ring coupling portion 21 is extended and then inserted and mounted into the assembly groove 12 of the assembly portion, it is elastically brought into close contact with the assembly groove 12 and sealed and coupled by high sealing force.

Furthermore, the assembly portion 11 to which the ring coupling portion 21 of the silicone tube is coupled is formed such that the lower protrusion 11*b* extends longer than the upper protrusion 11*a* outward, and thus the insertion and mounting of the ring coupling portion 21 of the silicone tube into the assembly groove 12 of the assembly portion is facilitated and the ring coupling portion inserted and mounted into the assembly groove 12 is prevented from being separated downward by the lower protrusion 11*b*, thereby securely maintaining a sealed and coupled state.

After the top of the silicone tube 20 has been coupled in a sealed state, the horizontally bent portion 22 protruding inward from the lower end of the silicone tube 20 is located under the stop protrusion portion 13 horizontally extending outward from the lower portion of the feeding bottle body.

In this state, the sealing ring 35 is seated over the coupling protrusion portion 14 extending vertically from the bottom of the feeding bottle body and the sealing cap 30 is screwed thereonto, and thus the sealing ring 35 elastically presses the horizontally bent portion 22 of the silicone tube onto the stop protrusion portion 13 and achieves sealing.

As described above, with a simple structure in which the silicone tube 20 is directly fitted into the feeding bottle body 10 of the present invention and the upper and lower ends are coupled in a sealed manner, foreign materials are prevented from entering the inside of the feeding bottle body 10.

In this coupled state, the nipple 40 is seated and mounted on the top of the feeding bottle body 10, and the coupling cap 45 is screwed and fastened onto the top of the feeding bottle both.

In this coupled state, the feeding bottle of the present invention contains mother's milk or milk inside the feeding bottle body 10 and is used to feed milk to a child. Air is filled into the inside through the valve 25 of the silicone tube 20, and the feeding bottle is used by an infant in a state in which the silicone tube 20 is inflated. Accordingly, it improves the feel and provides a sense of stability like in the case of mother's milk.

When it is necessary to clean the inside of the silicone tube 20 during the use thereof, the sealing cap 30 on the bottom of the feeding bottle body is released to release the sealed and coupled stile of the bottom of the silicone tube 20.

Figure 7:
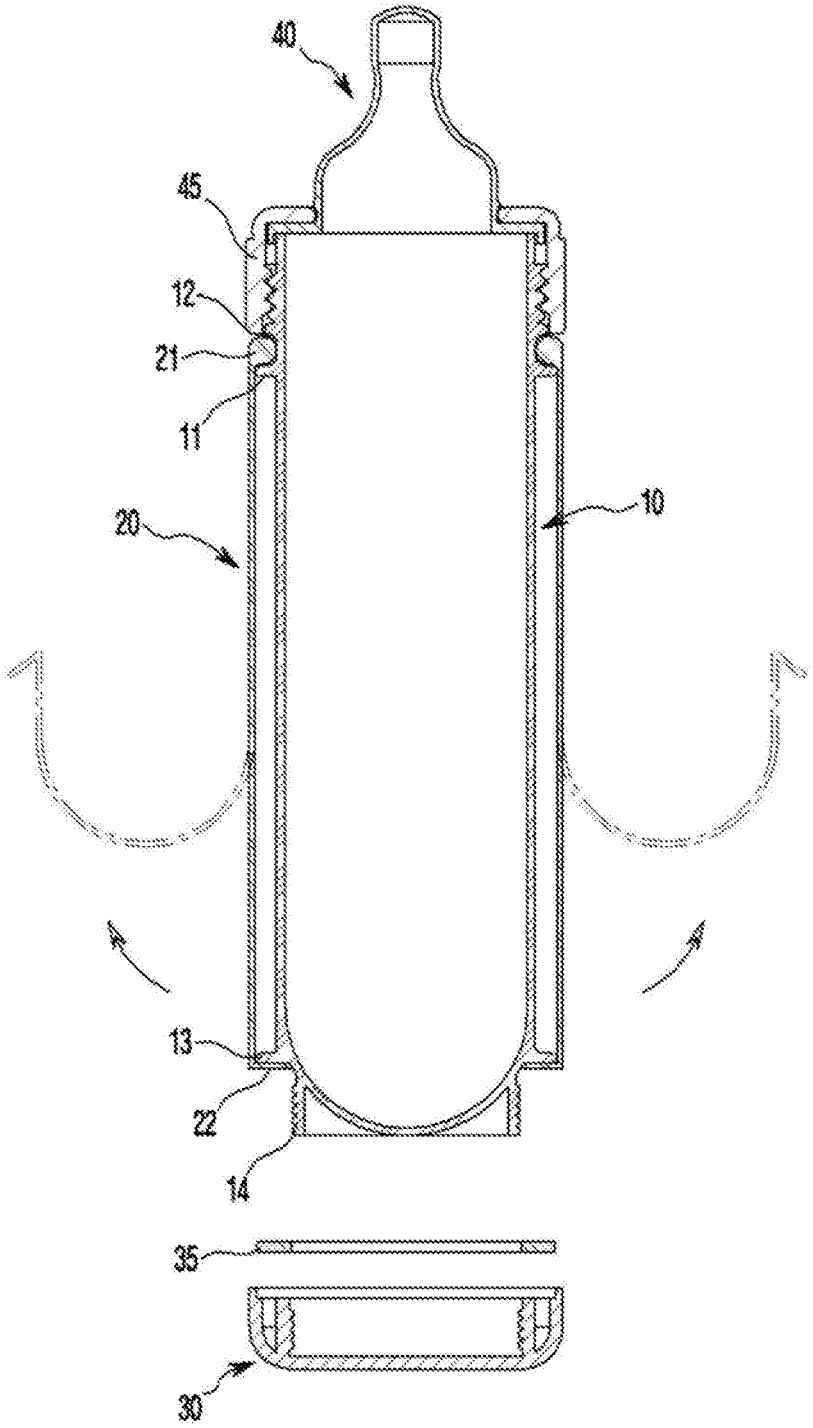
FIG. 7 is a sectional view showing a state in which an inside is cleaned after flipping the silicone tube of FIG. 3.

In this state, as shown in FIG. 7, a space is opened between the silicone tube 20 and the feeding bottle body 10 by flipping the bottom of the silicone tube upward, and thus the cleaning of the inside is conveniently performed.

After the above-described cleaning, the lower end of the silicone tube 20 is coupled to the feeding bottle body in a sealed manner again, and is then used.

Therefore, with the simple structure in which the present invention is configured to directly insert and couple the silicone tube 20 onto the outside of the feeding bottle body 10 without requiring a separate cover as in the prior art, the ring coupling portion 21 on the top of the silicone tube is coupled to the assembly groove 12 in a sealed manner, and the horizontal bent portion 22 on the bottom of the silicone tube 20 is coupled in a sealed manner by screwing the sealing cap, manufacturing cost is reduced, assembly and disassembly are facilitated, foreign materials are prevented from entering the inside thereof, and the cleaning of the inside thereof is facilitated by flipping the silicone tube.

What is claimed is:

1. A silicone tube coupled baby feeding bottle, wherein an assembly portion (11) configured to protrude from an outside of a top of a feeding bottle body (10) and to have a ring-shaped assembly groove (12), a stop protrusion portion (13) configured to extend horizontally from an outside of a bottom of the feeding bottle body (10), and a coupling protrusion portion (14) configured to extend vertically are formed; and a silicone tube (20) formed in a vertical hollow structure and configured such that a valve (25) filling and discharging air is formed in one side thereof is fitted into an outside of the feeding bottle body (10); an upper end of the silicone tube (20) is timed to be inwardly thicker than the tube, forms a ring coupling portion (21) having a large ring-shaped cross-section and high elasticity, and is coupled to the assembly groove (12) of the assembly portion in a sealed manner by being inserted to come into close contact with the assembly groove (12) of the assembly portion; and a lower end of the silicone tube (20) forms a horizontally bent portion (22) inward, and is coupled in a sealed manner by locating the horizontally bent portion (22) under the stop protrusion portion (13) and then pressing the horizontally bent portion (22) with the sealing cap (30) screwed to the coupling protrusion portion (14).

2. The silicone tube coupled baby feeding bottle of claim 1, wherein the assembly portion (11) of the feeding bottle body is formed such that a lower protrusion (11*b*) extends longer than an upper protrusion (11*a*) outward, thereby preventing the ring coupling portion (21) of the silicone tube from being separated downward from the assembly portion (11).

3. The silicone tube coupled baby feeding bottle of claim 1, wherein at least one sealing ring (35) configured to press and seal a tower end of the silicone tube (20) is inserted and disposed over the sealing cap (30).

* * * * *